US005091614A

United States Patent [19]

Yamamoto et al.

[11] Patent Number: 5,091,614

[45] Date of Patent: Feb. 25, 1992

[54] DISCONNECTING SWITCH

[75] Inventors: Hiroshi Yamamoto; Juichi Hirata, both of Amagasaki, Japan

[73] Assignee: Mitsubishi Denki Kabushiki Kaisha, Tokyo, Japan

[21] Appl. No.: 431,878

[22] Filed: Nov. 6, 1989

[30] Foreign Application Priority Data

Nov. 8, 1988 [JP] Japan ..... 63-146099[U]

[51] Int. Cl.[5] ..... H01H 33/02

[52] U.S. Cl. ..... 200/144 AP

[58] Field of Search ..... 200/144 AP, 148 B, 148 F; 361/10, 11

[56] References Cited

U.S. PATENT DOCUMENTS

| | | | |
|---|---|---|---|
| 2,401,963 | 6/1946 | Rietz et al. | 200/150 R |
| 3,912,974 | 10/1975 | Hill | 361/11 |
| 4,069,406 | 1/1978 | Meinders | 200/144 AP |

FOREIGN PATENT DOCUMENTS

| | | |
|---|---|---|
| 868020 | 2/1953 | Fed. Rep. of Germany . |
| 3242014 | 6/1983 | Fed. Rep. of Germany . |
| 56-110707 | 8/1981 | Japan . |
| 58-182323 | 11/1983 | Japan . |
| 2081976 | 2/1982 | United Kingdom . |

*Primary Examiner*—J. R. Scott

*Attorney, Agent, or Firm*—Oblon, Spivak, McClelland, Maier & Neustadt

[57] ABSTRACT

A disconnecting switch has two switches, wherein a first switch comprising a sliding arc contact, which is spring biased, is connected with a resistor in series, and a second switch comprising a main state contact is connected with the first switch with the resistor in parallel. A movable contact is driven so as to contact both the sliding arc contact over a given distance and the main static contact at a given position of the given distance. When the disconnecting switch is interrupted, the second switch is opened first and then the first switch is opened. Current limiting action due to the resistor enables easy interruption of the disconnecting switch.

3 Claims, 10 Drawing Sheets

DISCONNECTING SWITCH

FIELD OF THE INVENTION AND RELATED ART STATEMENT

1. Field of the Invention

The present invention relates generally to a disconnecting switch for switching a bus bar or a line by breaking current therein in a power station or a transforming station.

2. Description of the Related Art

A conventional disconnecting switch has been disclosed, for instance, in the gazette of Japanese unexamined published utility model application (Jikkai) Sho 60-88440, which is shown in FIGS. 5(*a*), 5(*b*) and 5(*c*). These figures are fragmentary sectional views of interrupting part in the disconnecting switch in a breaking process. FIGS. 6(*a*), 6(*b*) and 6(*c*) are equivalent circuits corresponding FIGS. 5(*a*), 5(*b*) and 5(*c*), respectively. The interrupting part consists of a main contact 2, an arc contact 3 and a movable contact 1. The arc contact 3 is set protruding beyond the main contact 2 toward the movable contact 1. Resistance owing to material having a relatively high resistance of the arc contact 3 is shown in FIGS. 6(*a*), 6(*b*) and 6(*c*) as an equivalent resistor 4. A switch 5 consists of the movable contact 1 and the main contact 2, and a switch 6 consists of the movable contact 1 and the arc contact 3. Arcs are generated at contact-parting in switches 5 and 6.

The contact-parting motion of the conventional disconnecting switch is explained with reference to FIGS. 5 and 6 and thereafter. FIGS. 5(*a*) and 6(*a*) show closed state of the disconnecting switch. Both the switches 5 and 6 are closed, wherein the movable contact 1 and the main contact 2 make a perfect touch and connection. In this case, current flow I is shown by an arrow. Next, the movable contact 1 is moved parting from the main contact 2, but is still touching with the arc contact 3 as shown in FIGS. 5(*b*) and 6(*b*); namely only the switch 5 is open, but the switch 6 is still closed. In this case current I flows in the switch 6 through the resistor 4. Then, the movable contact 1 is moved more parting from the arc contact 3 as shown in FIGS. 5(*c*) and 6(*c*). At the moment, an arc 7 is produced at the switch 6, namely across the gap between the arc contact 3 and the movable contact 1. Current limiting action by the resistor 4 accelerate extinction of the arc 7. And an interruption is completed at the same time.

In the above-mentioned disconnecting switch, inherent resistivity of material of the arc contact 3 per se is used as the resistor 4, and the current limiting action of the resistor 4 improves the interruption characteristic. The value of the resistance is determined by the material used and the size (such as thickness and length) of the arc contact 3, and is roughly within the range of several hundred $\mu\Omega$ to 1000 $\mu\Omega$. Thus the structure of the conventional disconnecting switch is suitable for improvement of the interruption characteristic only in the relatively small current range.

When the above-mentioned conventional disconnecting switch is intended to be used as a disconnecting switch for large capacity such as for breaking current of about 8000 A, it is necessary to improve the interruption characteristic thereof based on the current limiting action by increasing the value of resistor 4. Thus an increase of the inherent resistivity of the arc contact 3 is required. In order to increase the inherent resistivity, development of new material having both the arc resistivity and the inherent resistivity of several thousand times as large as those of Cu, or both extending of length and thinning of thickness of the arc contact are required. Production of such new material has been hopeless even in recent technology, and the above-mentioned extending of length and thinning of thickness of the arc contact will results in shortcomings such as lowering of mechanical reliability and large-size of switch itself.

OBJECT AND SUMMARY OF THE INVENTION

The object of the present invention is to solve the above-mentioned problems and obtain a disconnecting switch having an improved interruption characteristic based on its sufficient current limiting action with compact size.

The disconnecting switch in accordance with the present invention comprises:

- a container,
- a fixed electrode shield mounted in the container being insulated therefrom,
- a moving electrode shield mounted in the container being insulated therefrom, and from the fixed electrode shield,
- a movable contact having a rod-shaped sliding part, held slidably along the axis thereof in the moving electrode shield and electrically connected to the moving electrode shield,
- a main contact which is supported in the fixed electrode shield and electrically connected thereto, and is to contact the rod-shaped sliding part by sliding motion of the movable contact,
- a resistor supported in the fixed electrode shield, with its one end electrically connected with the fixed electrode shield, and
- an arc contact which is held movable in the fixed electrode shield and has a rear end electrically connected slidably to the other end of the resistor and a front end for touching the rod-shaped sliding part.

While the novel features of the invention are set forth particularly in the appended claims, the invention, both as to organization and content, will be better understood and appreciated, along with other objects and features thereof, from the following detailed description taken in conjunction with the drawings.

It will be recognized that some or all of the Figures are schematic representations for purposes of illustration and do not necessarily depict the actual relative sizes or locations of the elements shown.

DESCRIPTION OF THE PREFERRED EMBODIMENTS

Hereafter, a preferred embodiment is explained with reference to the accompanying drawings of FIG. 1 through FIG. 4.

Figure 1:
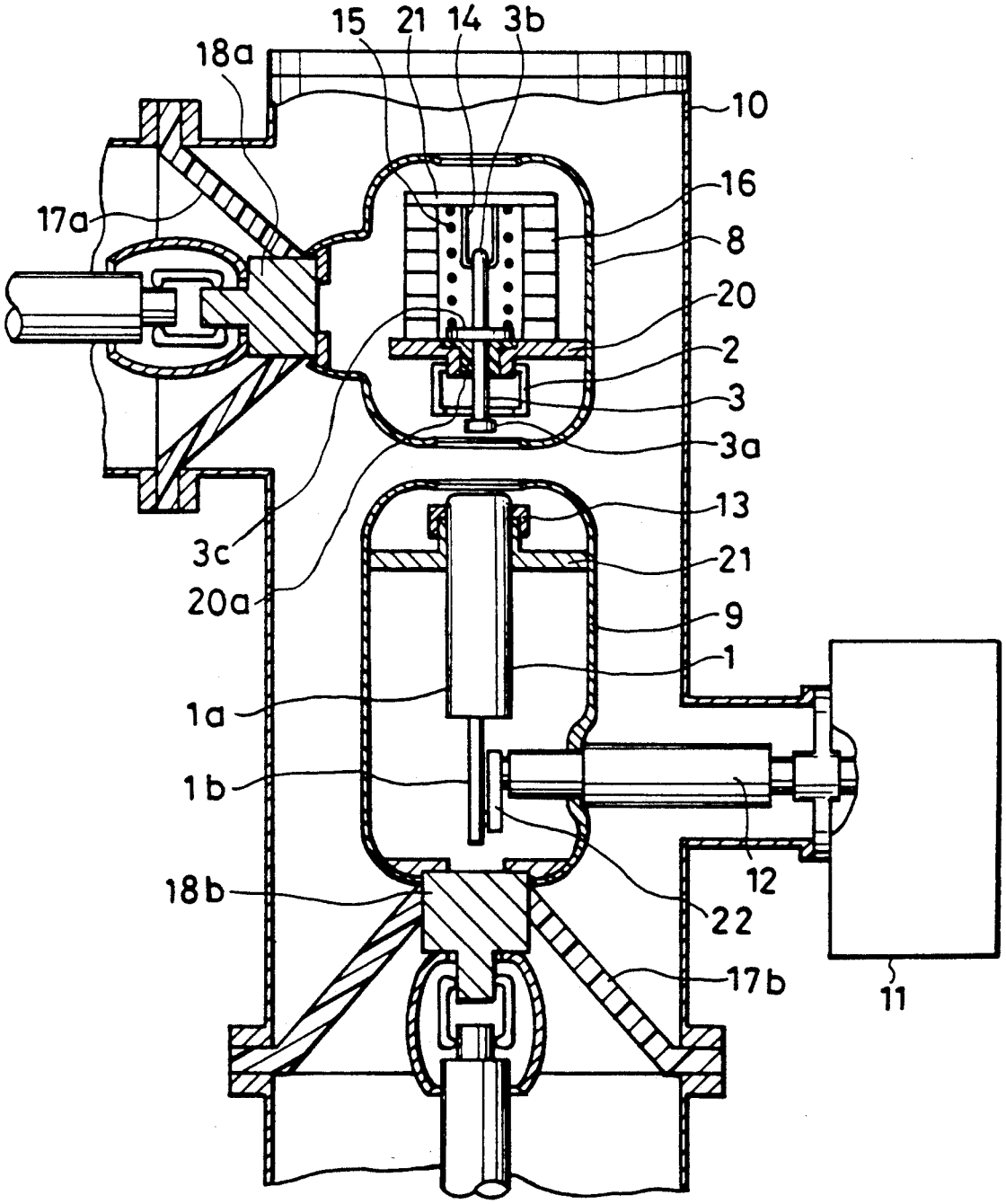
FIG. 1 is a vertical sectional view of a disconnecting switch of a first embodiment of the invention.

FIG. 1 is a vertical sectional view of a disconnecting switch of the present invention. In FIG. 1 a fixed electrode shield 8 (which is receiving a fixed contact namely a main contact 2) having a connection part (connector) 18*a* is held by an insulator 17*a*, which is supported in a container 10 by periphery thereof. Also a moving electrode shield 9 (which is receiving a movable contact 1) having a connection part (connector) 18*b* is held by an insulator 17*b*, which is supported in the container 10 by periphery thereof.

In the fixed electrode shield 8, a supporting conductor 20 for supporting an arc contact 3, the main contact 2 and resistors 16 etc., is attached therein. The arc contact 3 is composed of top end 3*a*, central flange portion 3*c*, and tail end 3*b*. A compression spring 15 is mounted between a connecting conductor plate 21 and the central flange portion 3*c*. The central flange portion 3*c* is pressed against an insulator 20*a* fixed to the supporting conductor 20 by resilient force of the spring 15. The arc contact 3 is slidably held in a through-hole of the insulator 20*a*. The arc contact 3 is insulated by the insulator 20*a*, and hence never electrically connected with the supporting conductor 20 directly. When the movable contact 1 moves upward and pushes the top end 3*a* upward, the upward motion of the arc contact overcomes the resilient force of the spring 15. Therefore, the arc contact 3 is slid upward, sliding through the through-hole of the insulator 20*a*. The tail end 3*b* of the arc contact 3 is inserted into a sliding conductor 14 whereby the arc contact 3 is electrically connected with the sliding conductor 14 while sliding upward and downward. The sliding conductor 14 is attached on the connecting conductor plate 21. A pile of several ring-shaped resistors 16, which are made of carbon resistor or the like is mounted between the connecting conductor plate 21 and the supporting conductor 20. The main contact 2 is fixed to the supporting conductor 20.

In the moving electrode shield 9, there are a supporting conductor 21, which is electrically connected thereto, and a movable contact 1. The movable contact 1 consists of cylindrical part 1*a* and a plate part 1*b*. The plate part 1*b* is connected with a crank cam 22, which is to be driven by an insulator rod 12. Side surface of upper part of the cylindrical part 1*a* slides in a through-holes of the supporting conductor 21 and a sliding conductor 13. Thus, the movable contact 1 is electrically connected with the moving electrode shield 9 through the sliding conductor and the supporting conductor 21. A drive mechanism 11 drives the crank cam 22 by rotating the insulator rod 12. The insulator rod insulates the movable contact 1 of high potential from the driver 11, which is of grounded potential.

Figure 2:
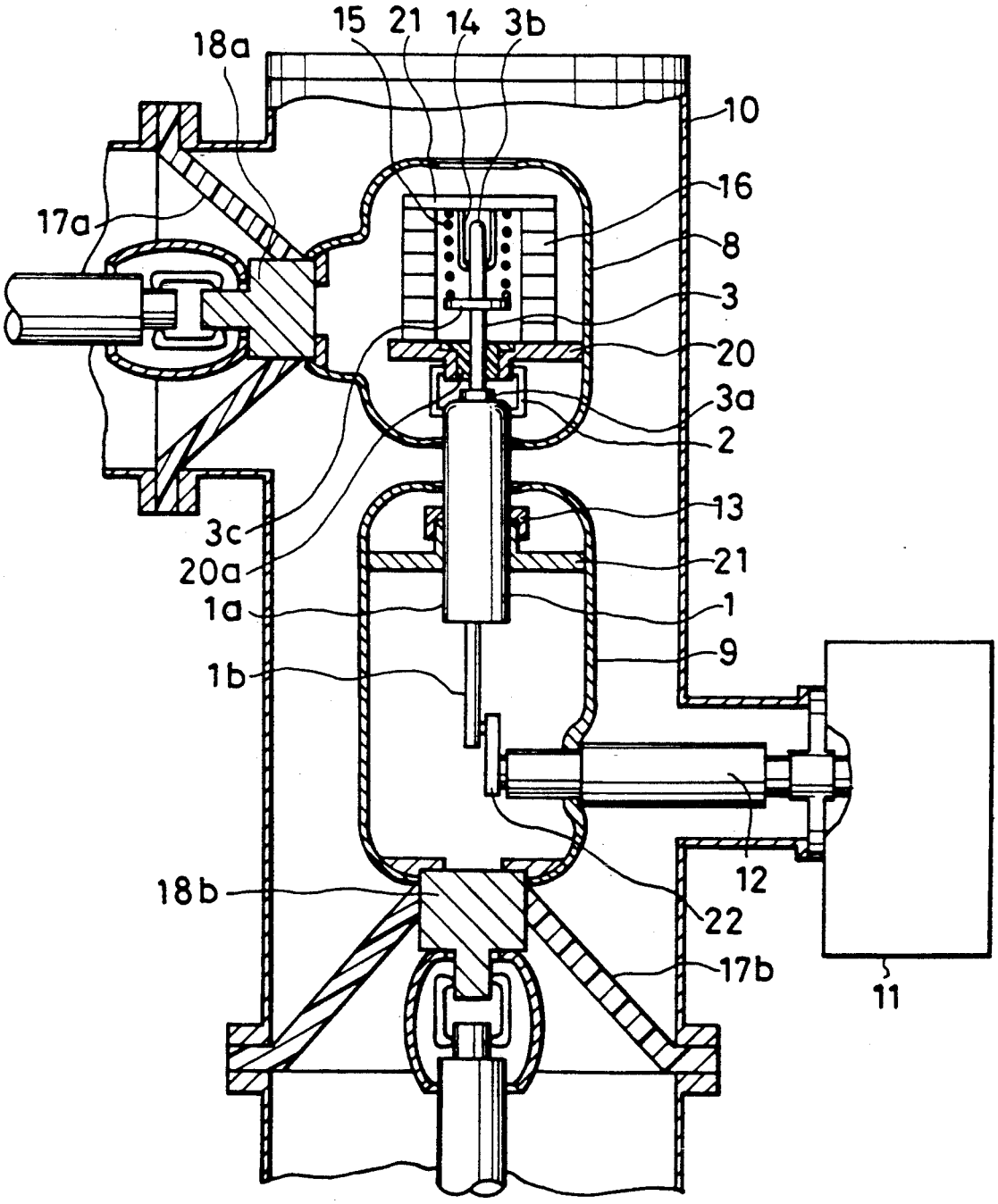
FIGS. 2(*a*), 2(*b*) and 2(*c*) are vertical sectional views of the disconnecting switch in different states of a breaking process.
Figure 2:
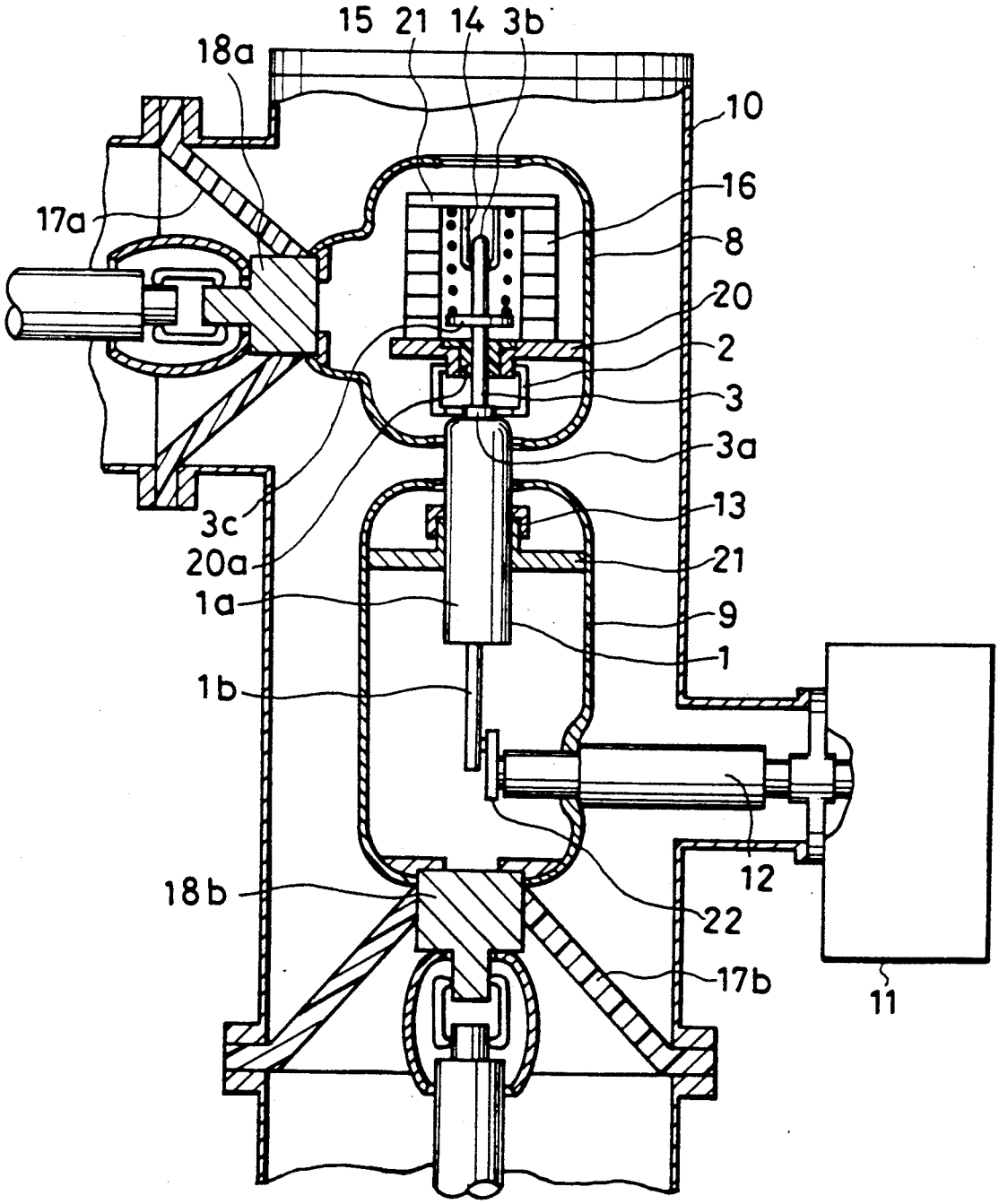
Figure 2C:
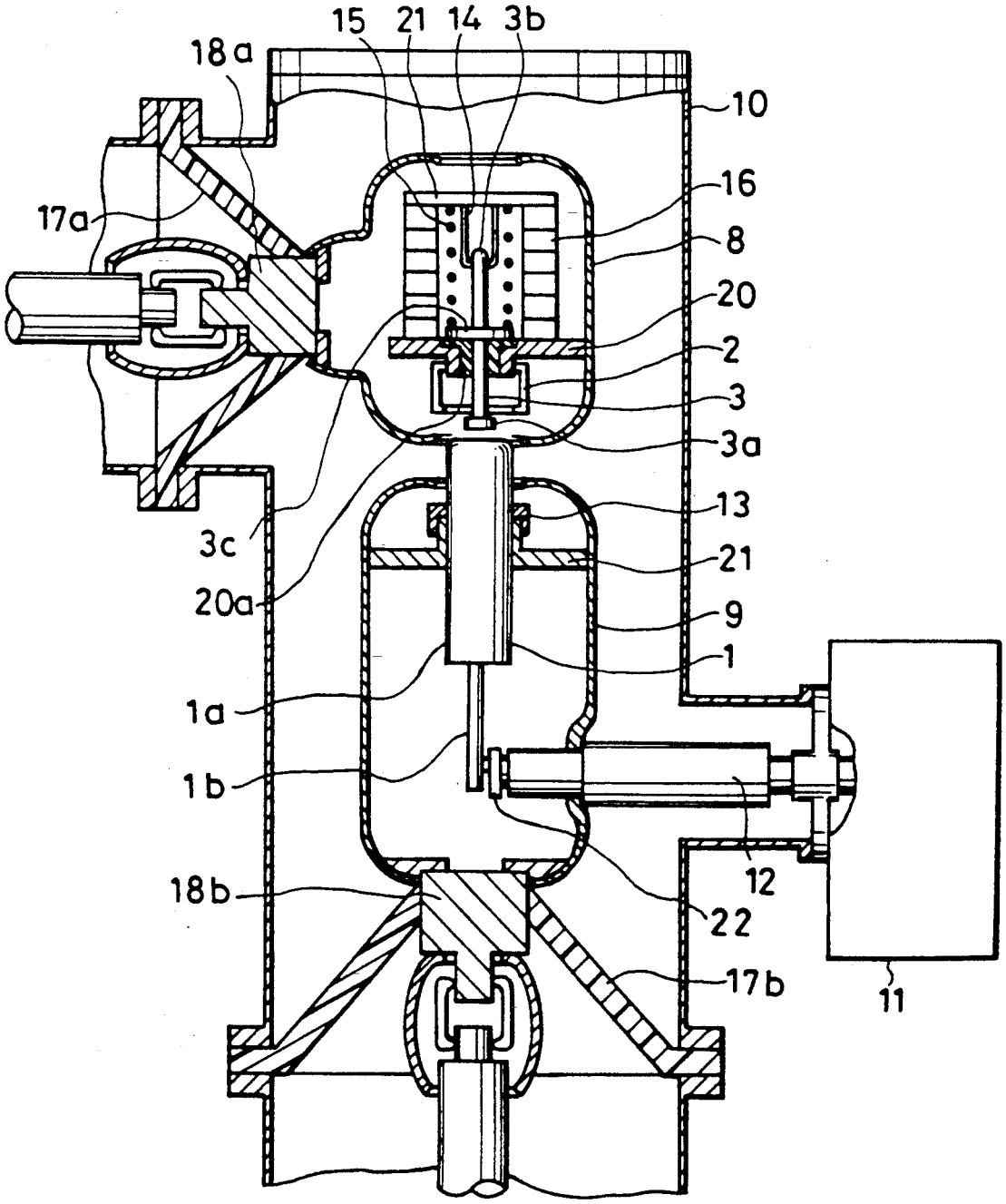

Next, the contact motion of the above-mentioned disconnecting switch is explained with reference to FIGS. 2(*a*), 2(*b*) and 2(*c*). FIGS. 2(*a*), 2(*b*) and 2(*c*) are vertical sectional views in various stages of breaking process of the disconnecting switch. In FIG. 2(*a*), wherein a closed state of the disconnecting switch is shown, the movable contact 1 contacts both the main contact 2 and the top end 3*a*. A current flows mainly through the movable contact 1 and the main contact 2. Next, the movable contact 1 is moved downward by the driver 11, and the movable contact 1 parts from the main contact 2 as shown in FIG. 2(*b*), but the top end face of the movable contact 1 is still in contact with the arc contact 3. Thereafter, the current flows through movable contact 1, the arc contact 3, the sliding conductor 14, the connecting conductor plate 21, the resistors 16 and the supporting conductor 20, to the fixed electrode shield 8, in this order. This current is sufficiently limited by the current limiting action by the resistors 16. Next, the movable contact moves further downward, and finally the top end face of the movable contact 1 parts from the arc contact 3 as shown in FIG. 2(*c*), and the resistor-limited current is interrupted.

Figure 3A:
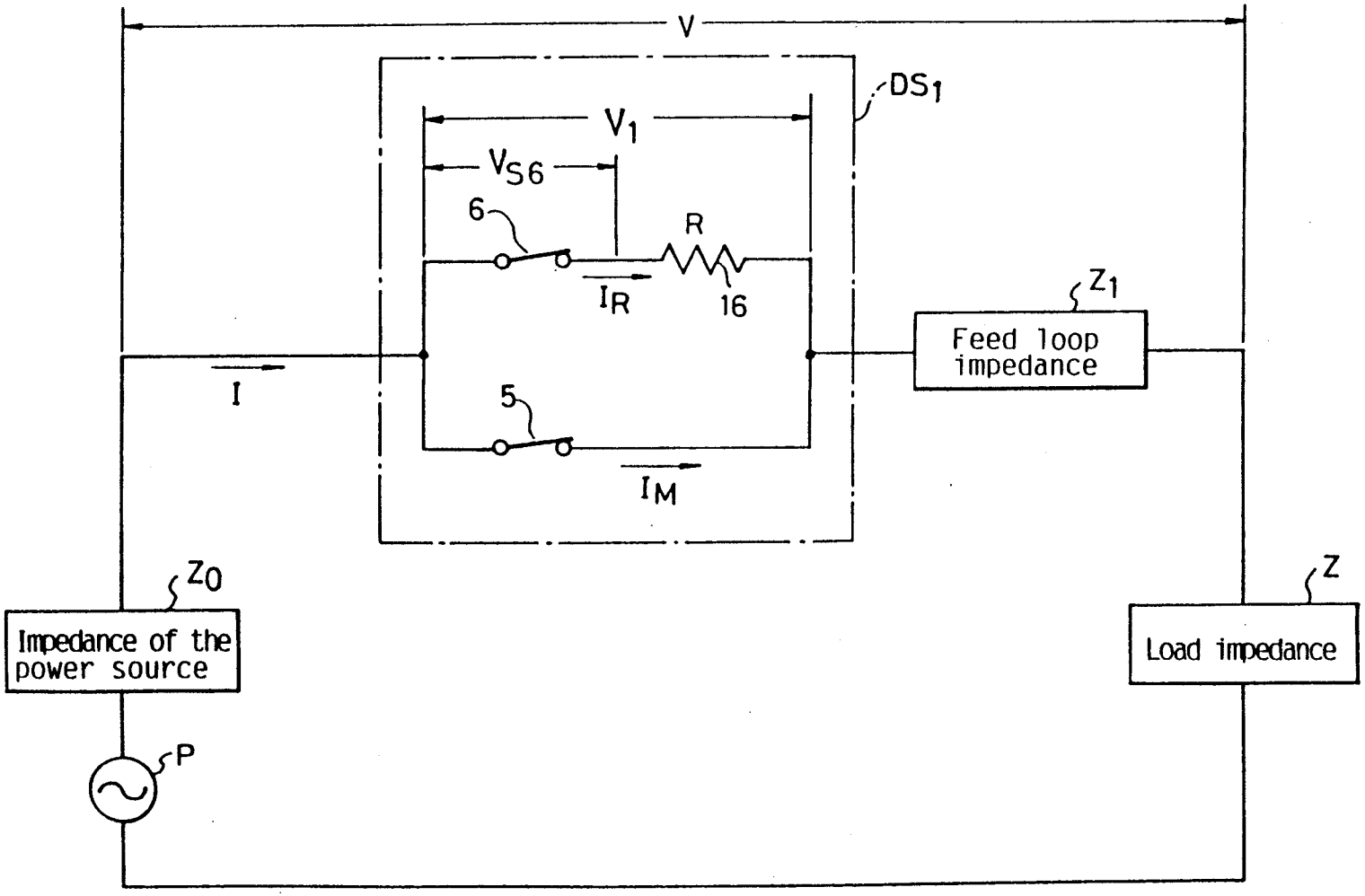
FIGS. 3(*a*), 3(*b*) and 3(*c*) are equivalent circuit diagrams for a single line of the disconnecting switch corresponding to FIGS. 2(*a*), 2(*b*) and 2(*c*), respectively.
Figure 3:
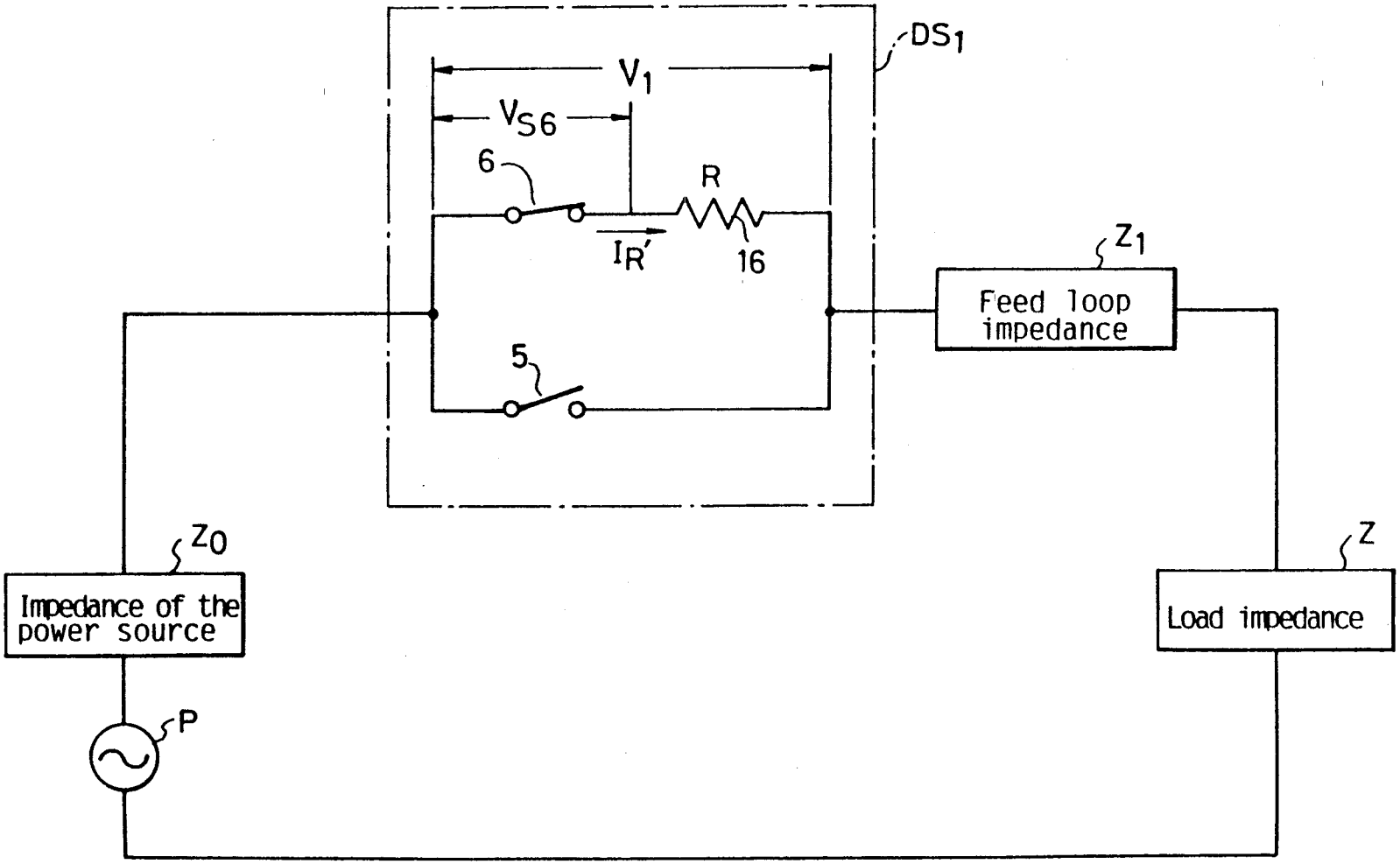
Figure 3C:
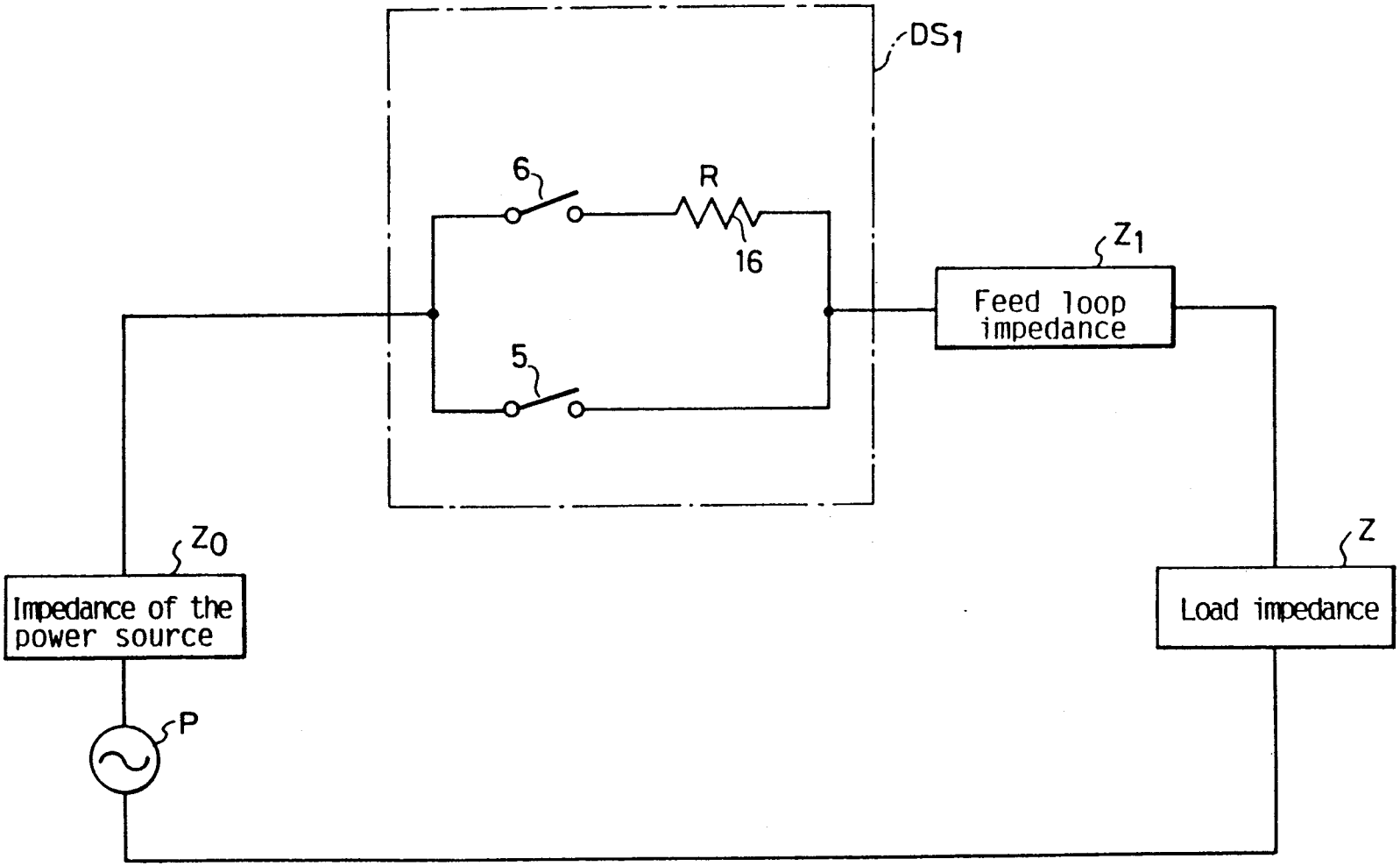

Hereafter, explanation is made on preferable value for the above-mentioned resistors 16 suitable for a disconnecting switch. At first a principle of the above-mentioned interruption using a resistor is explained. FIGS. 3(*a*), 3(*b*) and 3(*c*) are single-line equivalent circuit diagrams of the disconnecting switch shown in FIGS. 2(*a*), 2(*b*) and 2(*c*), respectively. In FIGS. 3(*a*), 3(*b*) and 3(*c*), mark P designates a power source, mark $Z_0$ represents impedance of the power source, mark $Z_1$ represents a feed loop impedance and mark Z designates a load impedance. Mark I designates the whole current, namely the load current. A disconnecting switch $DS_1$, which represents the disconnecting switch of FIG. 1, breaks the load current I. Mark $I_R$ designates a current portion flowing through a switch 6, which is formed by the movable contact 1 and the arc contact 3 (of FIG. 2), and the resistors 16 in series therewith. Mark $I_M$ designates a current portion flowing through a switch 5, which is formed by the movable contact 1 and the main contact 2.

Mark V designates a voltage across the feed line, and a mark $V_1$ designates a voltage across the disconnecting switch $DS_1$, and mark $V_{S6}$ designates a voltage across the switch 6. In the system, generally following inequality hold.

$$Z >> Z_0, Z_1 \quad (1).$$

When the disconnecting switch $DS_1$ is closed, namely both the switches 5 and 6 are closed (FIG. 3(*a*)), I is as follows:

$$I = I_R + I_M \quad (2).$$

When the disconnecting switch $DS_1$ is being opened, at first the state of the disconnecting switch $DS_1$ shown in FIG. 2(*a*) changes to that of FIG. 2(*b*). In the state of FIG. 2(*b*), the movable contact 1 is apart from the main contact 2, namely the switch 5 is opened. But the movable contact 1 is still in contact with the arc contact 3, namely the switch 6 is still closed (FIG. 3(*b*)). By the opening of the switch 5, the current $I_M$ in the switch 5 is interrupted, and the current $I_M$ transfer to the branch of the switch 6. The time period from opening of the switch 5 to the complete transfer of the current $I_M$ to the branch of the switch 6 depends on the inherent interrupting characteristics of the switch 5 and the ratio of resistance R of the resistors 16 to the impedance $Z_1$.

In case the resistors 16 were not introduced, an impedance of the arc contact 3 itself being negligibly small, the relation $V_1 = V_{S6} = 0$ holds. In such state the above-mentioned transfer of the current $I_M$ to the branch of the switch 6 is made instantaneously.

In case there is the resistors 16 as shown in FIGS. 3(*a*) or 3(*b*), the voltage $V_1$ of $V_1 = I_R \times R$ is generated between the movable contact 1 and the main contact 2. Thus, the higher the resistance of the resistors 16 is, the higher the voltage $V_1$ and its rise rate become. In case the rise rate of voltage $V_1$ is too high, an arc may be generated, hence an arc current flows in the switch 5, and the interruption of the switch 5 may fail. Accordingly the value R of the resistors 16 has an upper limit.

When selection of the above-mentioned value of R is suitable, the current $I_M$ is interrupted, and a current $I_R'$ in the branch of the switch 6 and the resistors 16 (which is designated as $I_R'$ and is larger than $I_R$) flows, as shown in FIG. 3(*b*). In FIG. 3(*b*), the current $I_R'$ is dependent on a combined impedance $Z_1'$, which is a combination of impedance $Z_1$ and R. For instance, the combined impedance $Z_1'$ is expressed as follows:

$$Z_1' = \sqrt{Z_1^2 + R^2} > Z_1. \quad (3)$$

As is apparent from the equation (3), $Z_1'$ is larger than $Z_1$. Therefore, the current $I_R'$ is smaller than I. When finally the switch 6 is opened as shown in FIG. 3(*c*), the smaller current $I_R'$ can be interrupted with ease by the switch 6.

Further, the higher the value of R is, the less the phase difference between the voltage $V_{S6}$ and the current $I_R'$ becomes. Therefore, recovery voltage and recovery period immediately after the interruption become low and short, respectively. Thus the switch 6 can break the current $I_R'$ with ease.

As mentioned above, at the time of opening the switch 5 and interrupting the current $I_M$ in the switch 5 to transfer the current to the branch of the switch 6, the smaller the respective value of R is, the easier the transfer of the current hence interruption of the current of the switch 5 is. On the contrary, at the time of opening the switch 6, the larger the value of R is, the easier the interruption of switch 6 is.

Figure 4:
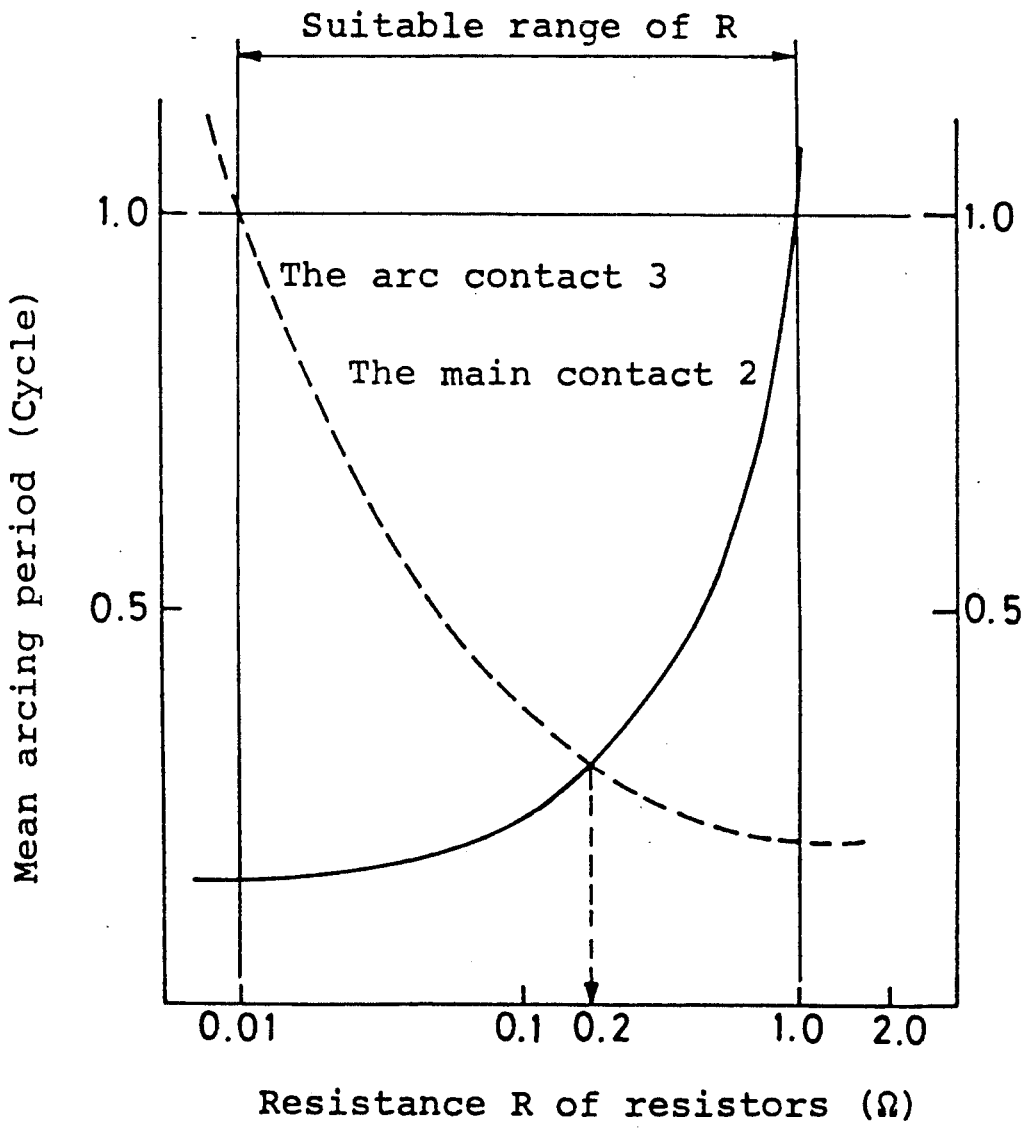
FIG. 4 is a graph showing the first relation between the resistance R of a resistor and mean arcing period of the main contact 2 and the second relation between the resistance R of a resistor and mean arcing period of the arc contact 3.
Figure 5A:
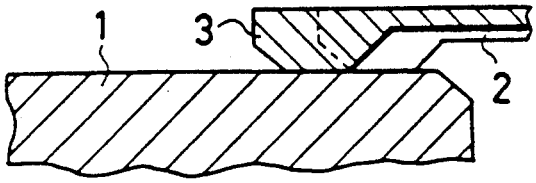
FIG. 5(a) (Prior Art)
FIGS. 5(*a*), 5(*b*) and 5(*c*) are fragmentary sectional views of interrupting part of the conventional disconnecting switch in a breaking process.
Figure 5B:
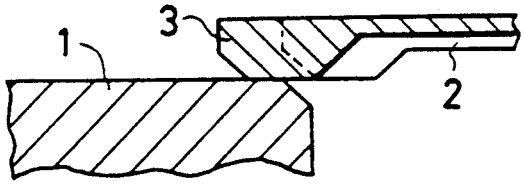
FIG. 5(b) (Prior Art)
Figure 5C:
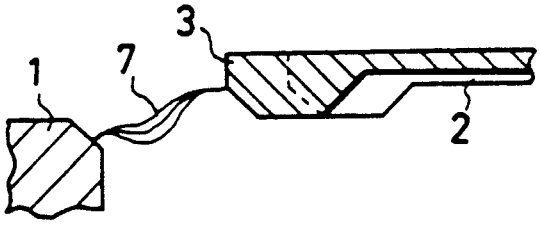
FIG 5(c) (Prior Art)
Figure 6A:
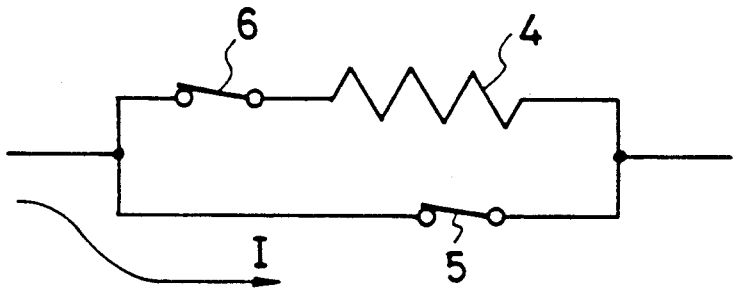
FIG.6(a)(Prior Art)
FIGS. 6(*a*), 6(*b*) and 6(*c*) are equivalent circuit diagrams for a single line of the disconnecting switch corresponding to FIGS. 5(*a*), 5(*b*) and 5(*c*), respectively.
Figure 6B:
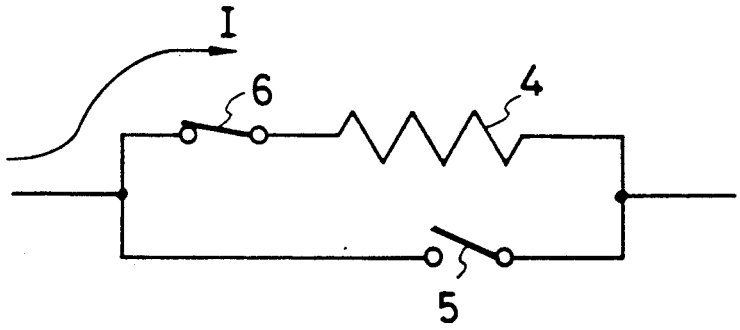
FIG.6(b)(Prior Art)
Figure 6C:
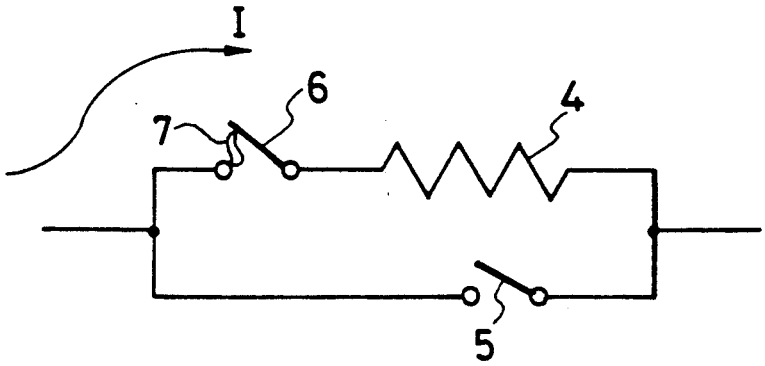
FIG.6(c)(Prior Art)

The easy interruption of the disconnector of the present invention owes to short arcing period or no arcing. As an example of operation the relation between resistance R of resistors 16 and mean arcing period of the main contact 2, and the relation between resistance R of resistors 16 and mean arcing period of the arc contact 3 (switch 6 of FIGS. 3(*a*), 3(*b*) and 3(*c*)) in a disconnecting switch, obtained by experiments is shown in FIG. 4. The example disconnector is operated for loop current of 8000 A, recovery voltage of 300 V. A requirement for a disconnecting switch is an interruption characteristic for enabling about 200 time successive interruption of loop current without maintenance or checking. In order to obtain the interrupting characteristic, it is necessary to shorten the above-mentioned both arcing periods to the utmost. For the disconnecting switch of a large capacity, it is confirmed important to keep the arcing period shorter than one cycle for highly reliable interruptions of many times, from the result of experiments. Therefore, it is appropriate to select the value of resistance R within the range from 0.01 Ω to 1 Ω as is understood from the graph of FIG. 4.

From a consideration that the resistance R which makes both the arcing periods of the main contact and the arc contact equal is of most suitable value, the value of R is to be selected about 0.2 Ω in this example. This value of 0.2 Ω is about 5 times as large as the loop impedance of a longest loop.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed:

1. A disconnecting switch comprising:

a container, a fixed electrode shield mounted in said container being insulated therefrom, a moving electrode shield mounted in said container being insulated therefrom and from said fixed electrode shield, a movable contact having a rod-shaped sliding part, held slidably along the axis thereof in said moving electrode shield and electrically connected to said moving electrode shield, a main contact which is supported in said fixed electrode shield and electrically connected thereto, and is to contact said rod-shaped sliding part by sliding motion of said movable contact, a resistor supported in said fixed electrode shield with its one end electrically connected with said fixed electrode shield, and an arc contact which is held movable in said fixed electrode shield and has a rear end electrically connected slidably to the other end of said resistor and a front end for touching said rod-shaped sliding part.

2. A disconnecting switch according to claim 1, wherein a series circuit comprises at least said arc contact and the resistor, and wherein a second switch comprising at least said main contact is connected in parallel with said series circuit, and wherein said second switch is opened earlier than said first switch.

3. A disconnecting switch in accordance with claim 2 wherein;

said resistor has resistance from 0.01 Ω to 1 Ω.

* * * * *